US008783210B2

(12) United States Patent
Takayama

(10) Patent No.: US 8,783,210 B2
(45) Date of Patent: Jul. 22, 2014

(54) ROBOT COATING SYSTEM

(71) Applicant: FANUC Corporation, Yamanashi (JP)

(72) Inventor: Yuusake Takayama, Yamanashi (JP)

(73) Assignee: FANUC Corporation, Minamitsuru-gun, Yamanashi (JP)

( * ) Notice: Subject to any disclaimer, the term of this patent is extended or adjusted under 35 U.S.C. 154(b) by 0 days.

(21) Appl. No.: 13/834,174

(22) Filed: Mar. 15, 2013

(65) Prior Publication Data

US 2013/0284088 A1 Oct. 31, 2013

(30) Foreign Application Priority Data

Apr. 26, 2012 (JP) ..... 2012-101332

(51) Int. Cl.
*B05B 3/00* (2006.01)
*B05C 11/10* (2006.01)

(52) U.S. Cl.
USPC ..... 118/683; 118/696; 118/323; 118/321; 901/43; 700/23

(58) Field of Classification Search
CPC ..... B05B 13/04
USPC ..... 118/321, 323, 683, 695–699; 901/43; 700/123; 427/427.2, 427.3, 8; 239/587.1, 587.5
See application file for complete search history.

(56) References Cited

FOREIGN PATENT DOCUMENTS

| | | | |
|---|---|---|---|
| JP | 04-322986 | | 11/1992 |
| JP | 07-080376 | | 3/1995 |
| JP | 3522329 | B | 11/1995 |
| JP | 09-182947 | | 7/1997 |
| JP | 10-000398 | | 1/1998 |
| JP | 3961820 | B | 6/2003 |
| JP | 2004-321852 | A | 11/2004 |
| JP | 2006-075699 | A | 3/2006 |
| JP | 2011-011139 | A | 1/2011 |

*Primary Examiner* — Yewebdar Tadesse
(74) *Attorney, Agent, or Firm* — Drinker Biddle & Reath LLP

(57) ABSTRACT

A robot coating system (1) includes a robot moving unit (21) which makes a robot (11) having a coating gun (12) successively move to a plurality of planned coating positions, a readying pressure imparting unit (22) which drives a pump (13) of the coating gun before reaching the planned coating positions and imparts to the viscous material a predetermined readying pressure without coating the viscous material, a coating executing unit (23) which executes coating work of the viscous material by a predetermined flow rate over a predetermined coating time when the coating gun has reached a planned coating position, and a post-coating stopping unit (24) which continues the coating work to make the pump stop after the end of the work when executing the coating work and a stop command of the robot is issued.

4 Claims, 10 Drawing Sheets

FIG. 10

| | |
|---|---|
| COATING CONDITION | #1 |
| FLOW RATE | 1cc/sec |
| NOZZLE OPENING TIME | 50msec |
| PILOT PRESSURE RATE | 50% |
| PILOT PRESSURE TIME | 50msec |

FIG. 11

```
POSITION[1]  1000mm/sec  SMOOTH  100 SS[1]
POSITION[2]  1000mm/sec  SMOOTH  100 SS[1]
POSITION[3]  1000mm/sec  SMOOTH  100 SS[1]
```

ROBOT COATING SYSTEM

RELATED APPLICATION DATA

This application claims priority under 35 U.S.C. §119 and/or §365 to Japanese Application No. 2012-101332 filed Apr. 26, 2012, the entire contents of which is incorporated herein by reference.

BACKGROUND OF THE INVENTION

1. Field of the Invention

The present invention relates to a robot coating system which includes a robot which is provided with a coating gun which uses a pump to coat a viscous material and by which the coating gun coats a plurality of planned coating positions on a workpiece with a viscous material in exactly predetermined amounts to thereby scatter coat the viscous material.

2. Description of the Related Art

An industrial robot, for example, a multiarticulated robot, which coats a viscous material includes a coating gun which is attached to the tip of the robot arm. The coating gun is provided with a pump. If driving the pump, the nozzle of the coating gun discharges a viscous material, for example, a paint or sealing material (see Japanese Patent No. 3961820 and Japanese Patent No. 3522329).

In coating work which coats a viscous material, it is necessary to define the start and end positions. A first method provides a robot teaching program in which a coating start position and a coating end position are defined. This method is used for coating work which coats a viscous material by a straight continuous path.

In a second method, a robot is made to temporarily stop at a target position, then the viscous material starts to be coated. Further, when predetermined coating work is completed with a designated coating time and coating speed or coating amount, the robot is made to move to the next target position where the above-mentioned coating work is again performed. This is frequently used in the case of scatter coating which repeatedly coats a plurality of target positions with fixed coating amounts.

In both the above-mentioned first and second methods, when some sort of abnormality occurs at the robot at the time of the robot coating work and an alarm is issued and the robot stopped, the coating gun simultaneously stops. In this case, the coating gun stops before discharging the intended coating amount.

In this connection, the first method designates a coating start position and a coating end position. This is suitable for coating work which coats a viscous material without interruption on a continuous path. However, in the first method, the time which is required from the coating start to coating end is determined in accordance with the content of operation of the robot. Obtaining the time uniquely is extremely difficult.

Further, the amount of coating of the viscous material at the coating gun is determined in accordance with the coating speed, coating time, internal pressure of the viscous material before coating (hereinafter referred to as the "pilot pressure"), etc. Therefore, if using the first method for scatter coating, the coating time is not uniquely determined, so a fixed amount of coating cannot be obtained. Therefore, when coating a sealing material, there is a possibility of variation occurring in the sealing strength. Furthermore, when the coating gun stops, the coating work is interrupted, then the coating work is resumed, it is hard to make the sum of the amount of coating before resumption of the coating work and the amount of coating after resumption strictly match with the intended amount of coating.

Furthermore, in the second method as well, there is a similar problem when the coating gun is stopped, the coating work is interrupted, then the coating work is resumed. In the second method, it is necessary to make the robot stop temporarily at the target position in the coating work, so there is the problem that the cycle time of the robot system increases.

The present invention was made in consideration of this situation and has as its object to provide a robot coating system wherein the amount of coating of the viscous material does not change from the intended coating amount even if the coating work is interrupted and then the coating work is resumed.

SUMMARY OF THE INVENTION

To achieve the above-mentioned object, according to a first aspect, there is provided a robot coating system which includes a robot which is provided with a coating gun which uses a pump to coat a viscous material and in which the coating gun coats a plurality of planned coating positions of a workpiece with the viscous material in exactly predetermined amounts to thereby scatter coat the viscous material, the robot coating system comprising a robot moving unit which makes the robot which is provided with the coating gun successively move to the plurality of planned coating positions at the time of operation of the robot coating system, a pilot pressure imparting unit which drives the pump of the coating gun before reaching the planned coating positions and imparts to the viscous material a predetermined pilot pressure without coating the viscous material, a coating executing unit which executes coating work of the viscous material by a predetermined flow rate over a predetermined coating time when the coating gun has reached a planned coating position or immediately before that, and a post-coating stopping unit which continues the coating work by the coating executing unit and makes the pump stop after the end of the coating work when the coating executing unit is executing the coating work and a command is issued to stop the robot.

According to the second aspect, there is provided the first aspect which comprises an immediate stopping unit which makes the pump stop without continuing the coating work by the coating executing unit when the coating executing unit is executing the coating work and a command is issued to stop the robot and a selection unit which selects one of the post-coating stopping unit and the immediate stopping unit for functioning.

According to the third aspect, there is provided the first or second aspect which further comprises a robot retracting unit which makes the robot retract to at least the coating start position when a stop command of the robot is issued and the robot stops over the coating start position of the planned coating position before coating the viscous material at one planned coating position among the plurality of planned coating positions.

According to the fourth aspect, there is provided any of the first to third aspects which further comprises an input unit which teaches coating conditions of the coating work and a display unit which displays at least one coating condition which is taught from the input unit including a coating time and flow rate of the viscous material and at least one planned coating position.

These objects, features, and advantages of the present invention and other objects, features, and advantages will become further clearer from the detailed description of typical embodiments of the present invention which are shown in the attached drawings.

BRIEF DESCRIPTION OF THE DRAWINGS

FIG. 10 is a view which shows the coating conditions which are displayed on a teaching panel.

FIG. 11 is a view which shows part of a coating program which is displayed on the teaching panel.

DETAILED DESCRIPTION

Below, the attached figures will be referred to so as to explain the embodiments of the present invention. In the following figures, similar members are assigned similar reference signs. To facilitate understanding, these figures are suitably changed in scale.

Figure 1:
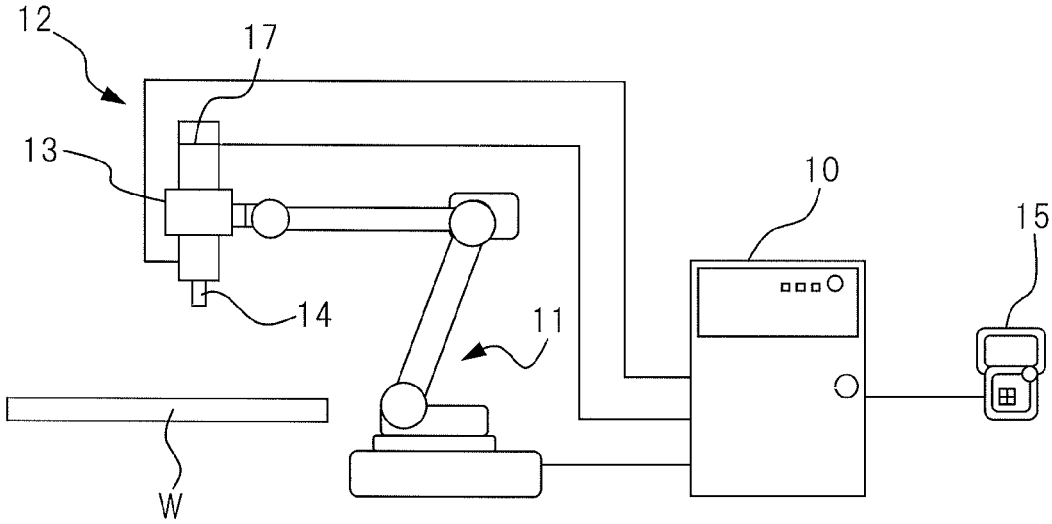
FIG. 1 is a schematic side view of a robot coating system according to a first embodiment of the present invention.

FIG. 1 is a schematic side view of a robot coating system according to a first embodiment of the present invention. As shown in FIG. 1, a robot coating system 1 mainly includes a multiarticulated robot 11 and a robot controller 10 which is connected to the multiarticulated robot 11. Furthermore, a teaching panel 15 is connected to the robot 11.

As shown in FIG. 1, the front end of the robot 11 is provided with a coating gun 12. The coating gun 12 is positioned by the robot 11. The coating gun 12 includes a pump 13 which pumps a viscous material, for example, a paint, sealing material, or adhesive, and imparts a predetermined pilot pressure to the viscous material, a nozzle 14 which is controlled to open and close by the robot controller 10, and an additional robot shaft 17.

The additional robot shaft 17 is controlled so as to be synchronized with a servo motor of the robot 11 and drives the pump 13. When imparting a predetermined pilot pressure to the viscous material, the nozzle 14 is closed while the pump 13 is driven. Further, when coating a viscous material on a workpiece, the pump 13 is driven while the nozzle 14 is opened.

Figure 2:
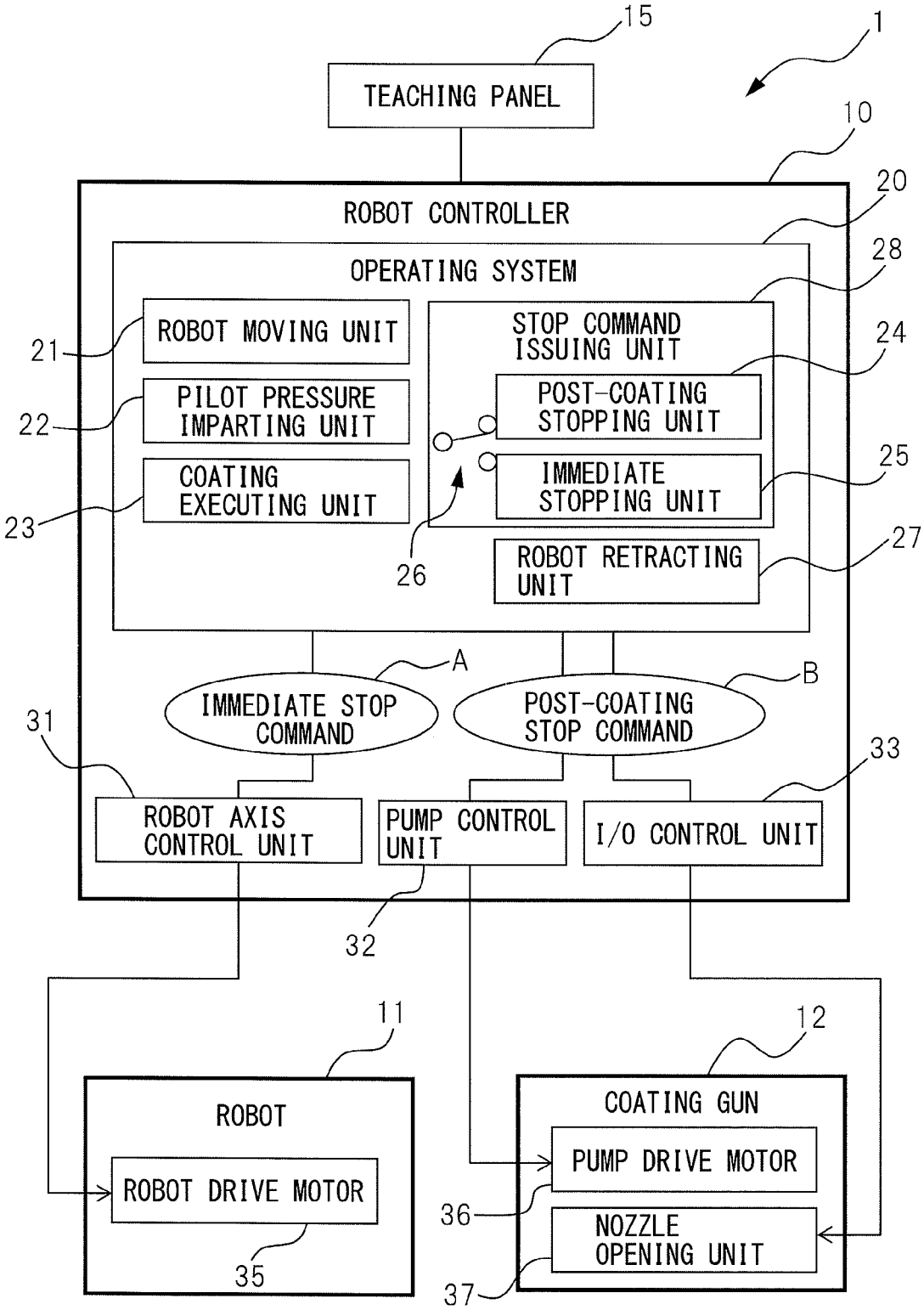
FIG. 2 is a functional block diagram of a robot coating system which is shown in FIG. 1.

FIG. 2 is a functional block diagram of the robot coating system which is shown in FIG. 1. As shown in FIG. 2, the robot controller 10 includes an operating system 20, robot axis control unit 31, pump control unit 32, and I/O control unit 33.

Further, as shown in FIG. 2, the robot axis control unit 31 controls a plurality of robot drive motors 35 which are provided at the robot 11. Similarly, the pump control unit 32 controls a pump drive motor 36 which drives the pump 13 of the coating gun 12. Furthermore, the I/O control unit 33 controls a nozzle opening unit 37 which opens and closes the nozzle 14 of the coating gun 12.

Further, the operating system 20 of the robot controller 10 includes a robot moving unit 21 which makes the robot 11 move successively to a plurality of planned coating positions on a workpiece W, a pilot pressure imparting unit 22 which drives the pump 13 of the coating gun 12 to impart to the viscous material a predetermined pilot pressure without coating the viscous material before reaching the planned coating position, and a coating executing unit 23 which executes coating work of the viscous material by a predetermined flow rate over a predetermined coating time when the coating gun 12 reaches the planned coating positions or right before that.

Furthermore, the operating system 20 of the robot controller 10 includes a stop command issuing unit 28 which issues a stop command of a robot 11. The stop command issuing unit 28 prepares a stop command which makes the robot 11 stop when the robot 11 contacts a peripheral device (not shown) at the time of operation of the robot 11, when the viscous material which should be supplied runs out, when the load applied to the robot drive motor 35 or pump drive motor 36 is larger than the respective threshold value, or when another abnormality occurs.

As shown in FIG. 2, the stop command issuing unit 28 includes a post-coating stopping unit 24 which continues the coating work by the coating executing unit 23 and makes the pump 13 stop after the end of the coating work when coating work is being executed and a stop command of the robot 11 is issued and an immediate stopping unit 25 which makes the pump 13 stop without continuing the coating work by the coating executing unit 23 when the coating executing unit 23 is coating the viscous material and a stop command of the robot 11 is issued. The selection unit 26 of the stop command issuing unit 28 is used to select whether to issue a post-coating stop command B from the post-coating stopping unit 24 or to issue an immediate stop command A from the immediate stopping unit 25.

However, it should be noted that regardless of the selected content of the selection unit 26, an immediate stop command A is sent to a later explained robot axis control unit 31. An immediate stop command A or a post-coating stop command B are sent to a later explained pump control unit 32 and I/O control unit 33 in accordance with the selected content of the selection unit 26.

Further, the operating system 20 includes a robot retracting unit 27 which makes the robot 11 retract to at least the coating start position when a stop command of the robot 11 is issued before coating a viscous material at one planned coating position among a plurality of planned coating positions and the robot 11 passes the coating start position of the planned coating position.

Further, the teaching panel 15 performs the role as an input unit by which an operator instructs the coating conditions of coating work to the robot 11. The taught contents are supplied to the robot controller 10. Furthermore, the teaching panel 15 performs the role as a display unit which displays the taught coating conditions and the planned coating position.

Figure 3:
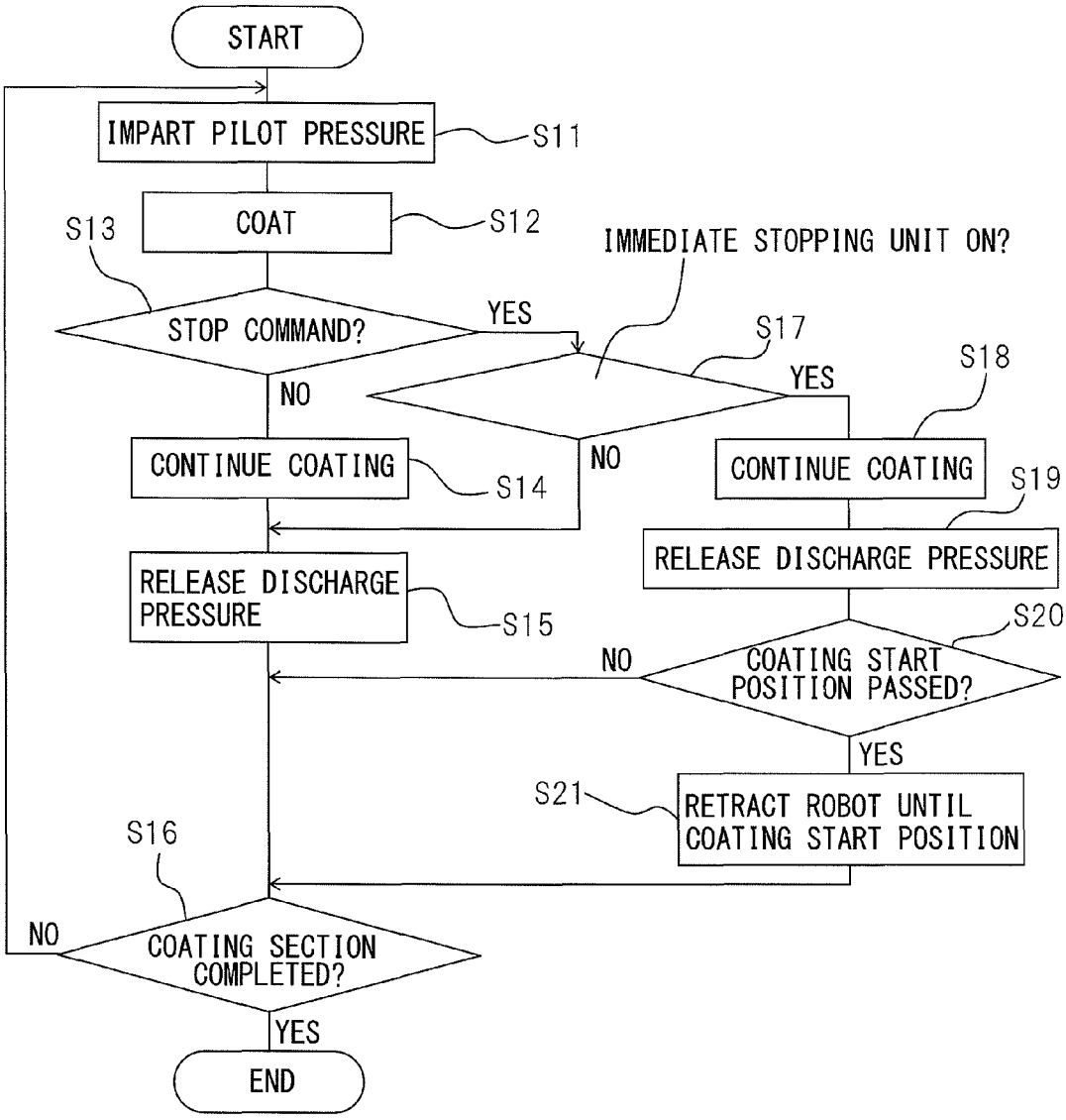
FIG. 3 is a flow chart which shows the operation of a robot coating system according to the present invention.

Here, FIG. 3 is a flow chart which shows the operation of a robot coating system according to the present invention. The operation which is shown in FIG. 3 is performed repeatedly every predetermined time shorter than the coating time for coating one planned coating position with the viscous material.

Figure 4:
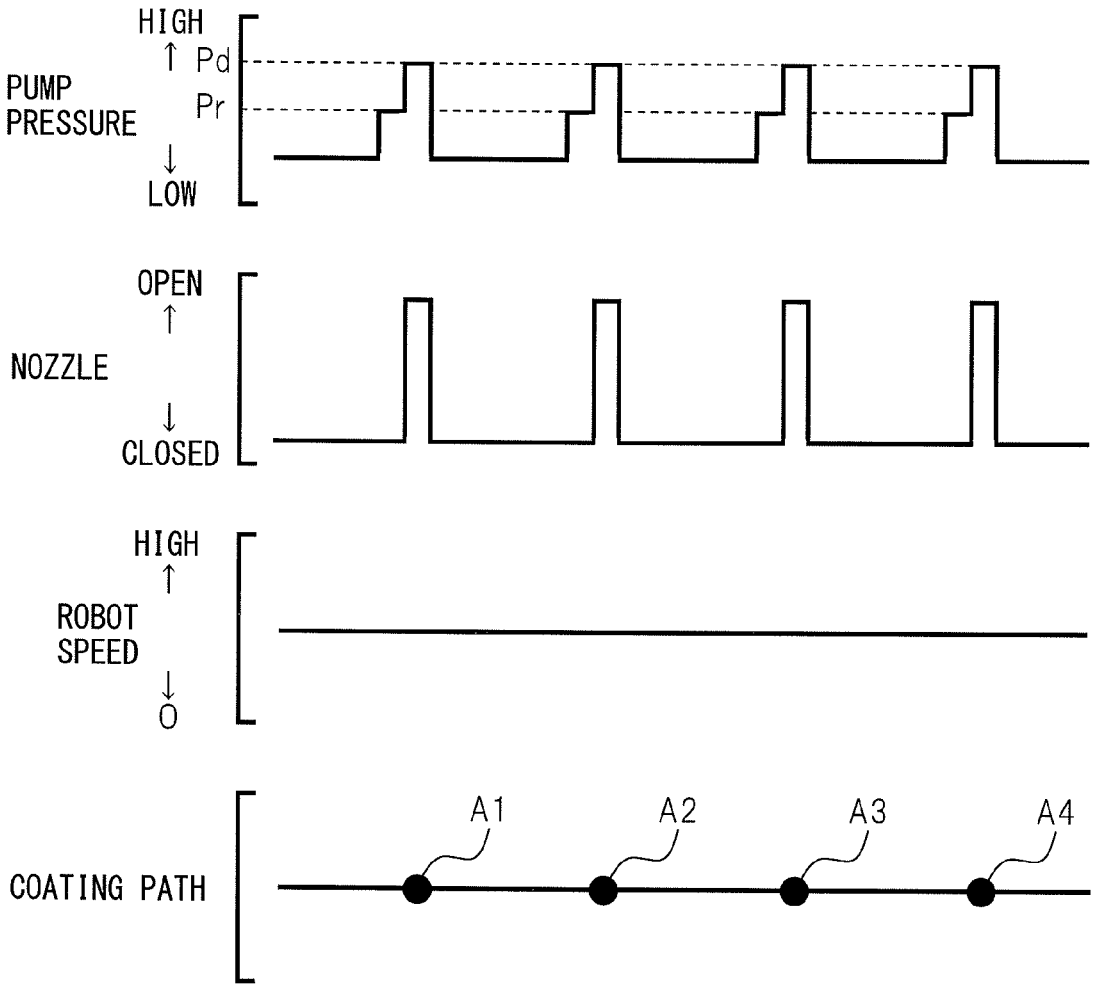
FIG. 4 is a view which shows a time chart of a pump pressure, nozzle, robot speed, and coating path.
Figure 5:
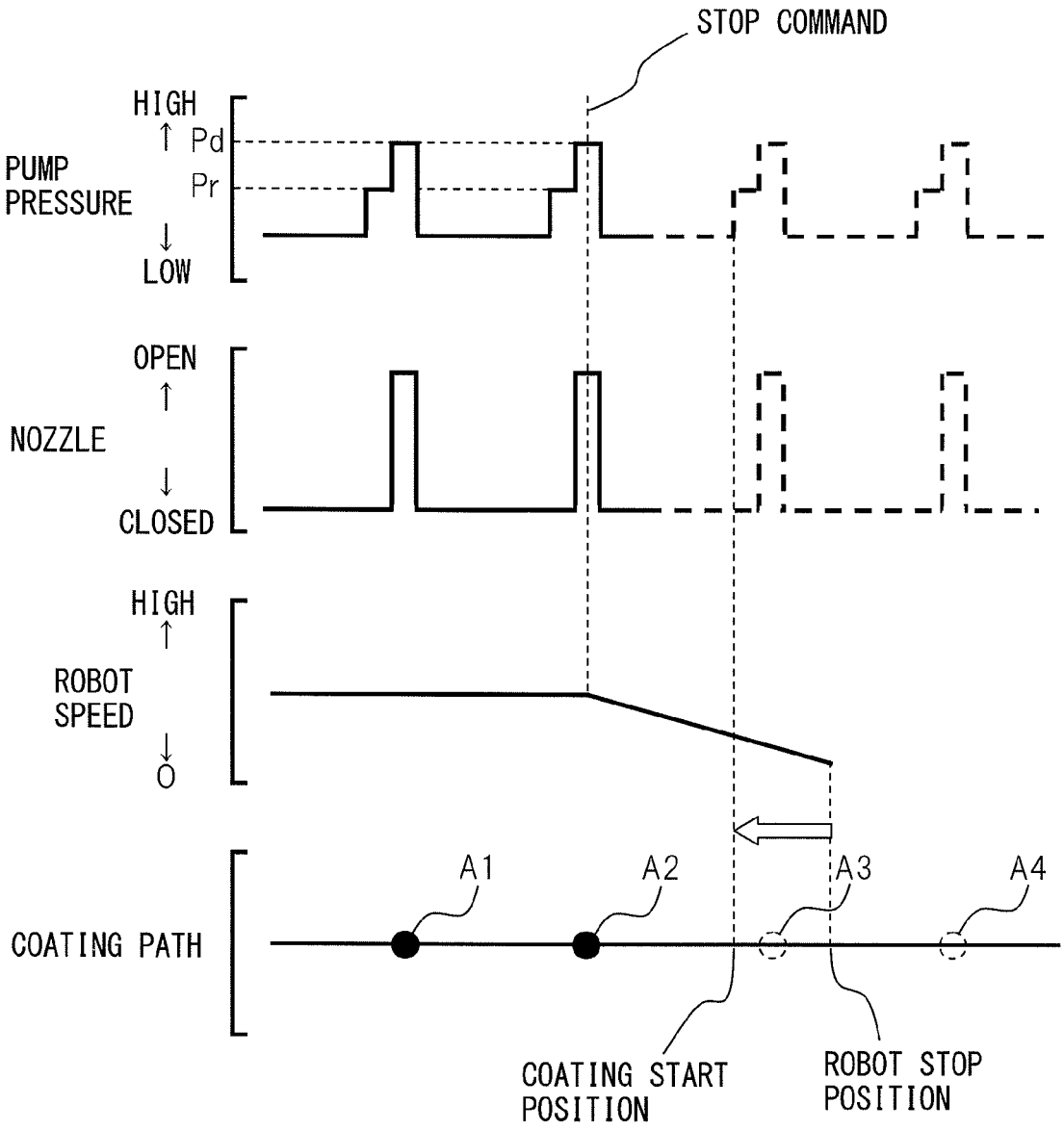
FIG. 5 is a view which shows a time chart of a pump pressure, nozzle, robot speed, and coating path when stopping coating work.

Further, FIG. 4 and FIG. 5 is a view which shows time charts of the pump pressure, nozzle, robot speed, and speed path. In FIG. 4 and FIG. 5, a plurality of planned coating positions are arranged at equal intervals on a coating path. However, a plurality of planned coating positions may be arranged at different intervals on the coating path. Below, referring to these drawings, the coating work of a viscous material by the robot coating system 1 will be explained.

Note that, in the following explanation, the explanation is given of the case where the workpiece W is fastened at a predetermined position and the robot 11 makes the coating gun 12 move for scatter coating of the viscous material. Here, "scatter coating" means spraying a plurality of planned coating positions predetermined on a straight or curved path with a viscous material in exactly predetermined amounts. Therefore, the operation which is shown in FIG. 3 is executed by the robot moving unit 21 making the robot 11 which is provided with the coating gun 12 successively move by a constant speed to a plurality of planned coating positions on the workpiece W.

First, at step S11 of FIG. 3, the pilot pressure imparting unit 22 closes the nozzle 14 through the nozzle opening unit 37 while driving the pump 13 through the pump drive motor 36. Due to this, as shown in FIG. 4, the viscous material of the pump 13 is given a predetermined pilot pressure Pr.

Then, at step S12, the coating executing unit 23 opens the nozzle 14 through the nozzle opening unit 37 while further drives the pump 13 through a pump drive motor 36. As a result, as shown in FIG. 4, the viscous material of the pump 13 is formed with a predetermined discharge pressure Pd. The discharge pressure Pd is larger than the pilot pressure Pr and the nozzle 14 is open, so the viscous material is discharged on the workpiece W from the nozzle 14 of the coating gun 12.

Further, at step S13, it is judged if a stop command issuing unit 28 issues a stop command of the robot 11 on the basis of occurrence of contact of the robot 11 with a peripheral device or another abnormality. If a stop command is not issued, the routine proceeds to step S14 where the coating work is continued.

As can be seen from FIG. 4, the opening time of the nozzle 14 and the time during which the discharge pressure Pd of the pump is maintained end generally simultaneously. Due to this, a planned coating position on the workpiece W is coated with exactly a predetermined amount of a viscous material by a predetermined flow rate over a predetermined coating time. In FIG. 4, the viscous material which is coated on the planned coating position is shown by black circles. In FIG. 5 and the later explained FIG. 6, a planned coating position which is not yet coated with a viscous material is shown by the broken lines.

If the viscous material is coated in exactly a predetermined amount, at step S15, the discharge pressure Pd of the pump is released and the pressure returns to zero. Further, at step S16, it is judged if the coating section has ended. In other words, it is judged if there is a planned coating position where viscous material has not been coated. Further, the processing of step S11 to step S16 is repeated until the coating work at all planned coating positions is ended.

In this regard, when it is judged at step S13 that the stop command issuing unit 28 has issued a stop command of the robot 11, the routine proceeds to step S17. At step S17, it is judged if the selection unit 26 which is shown in FIG. 2 has selected the immediate stopping unit 25. When the selection unit 26 is used to select the immediate stopping unit 25, an immediate stop command A is issued to the pump 13 and the routine proceeds to step S15 where the discharge pressure Pd is released. Note that, when the immediate stopping unit 25 is selected, this is advantageous for coating the viscous material in a straight continuous path.

As opposed to this, when, at step S17, the selection unit 26 is used to select the post-coating stopping unit 24, the routine proceeds to step S18. In this case, a post-coating stop command B is issued to the pump 13 and the coating work at the planned coating position at which the viscous material is currently being coated is continued.

At FIG. 5, a stop command is issued in the middle of the coating work at the planned coating position A2. Even in such a case, as shown in FIG. 5, the discharge pressure Pd and opening action of the nozzle 14 relating to the planned coating position A2 are maintained until the predetermined coating work ends. Further, if such coating work ends, at step S19, the discharge pressure Pd of the pump is released.

In this way, in the present invention, even when a stop command of the robot 11 has been issued, the pump is made to stop after the coating work at the corresponding planned coating position A2 has ended. Therefore, the amount of coating of the viscous material does not change from the intended coating amount. Consequently, it is possible to obtain a coating amount at the planned coating position A2 similar to the amount of coating at the planned coating position A1. In the present invention, the selection unit 26 is provided, so it becomes possible to select the post-coating stopping unit 24 or immediate stopping unit 25 in accordance with the content of coating.

In this regard, when it is judged at step S13 that the stop command issuing unit 28 has issued a stop command of the robot 11, the stop command causes the robot 11 to shift to a stop operation and coast. Therefore, as shown in FIG. 5, the speed of the robot 11 gradually falls and finally becomes zero. The position at which the robot 11 stops is called the "robot stop position".

Then, at step S20, it is judged that the robot stop position has passed the coating start position of the next planned coating position. When not passing the coating start position, the routine proceeds to step S16. As opposed to this, when passing the coating start position, the routine proceeds to step S20. At step S20, the robot is retracted and the robot stop position is returned to at least the coating start position of the next planned coating position.

In FIG. 5, while a stop command is issued in the middle of the coating work at the planned coating position A2, the coating work at the planned coating position A2 is continued and then ended. However, as can be seen from FIG. 5, the robot stop position at this time is at a location where the planned coating position A3 passes. For this reason, if resuming the operation of the robot 11 from the robot stop position, the coating work at the planned coating position A3 is skipped.

For this reason, in the present invention, the robot retracting unit 27 is used to make the robot 11 move to at least the coating start position of the planned coating position A3 along the coating path. In FIG. 5, the coating start position corresponds to the pilot pressure Pr start position at the planned coating position A3. However, it is also possible to employ a position further upstream from this position as the coating start position. In this way, in the present invention, at the time of scatter coating, it is possible to prevent coating work at part of the planned coating positions from being skipped.

Figure 6:
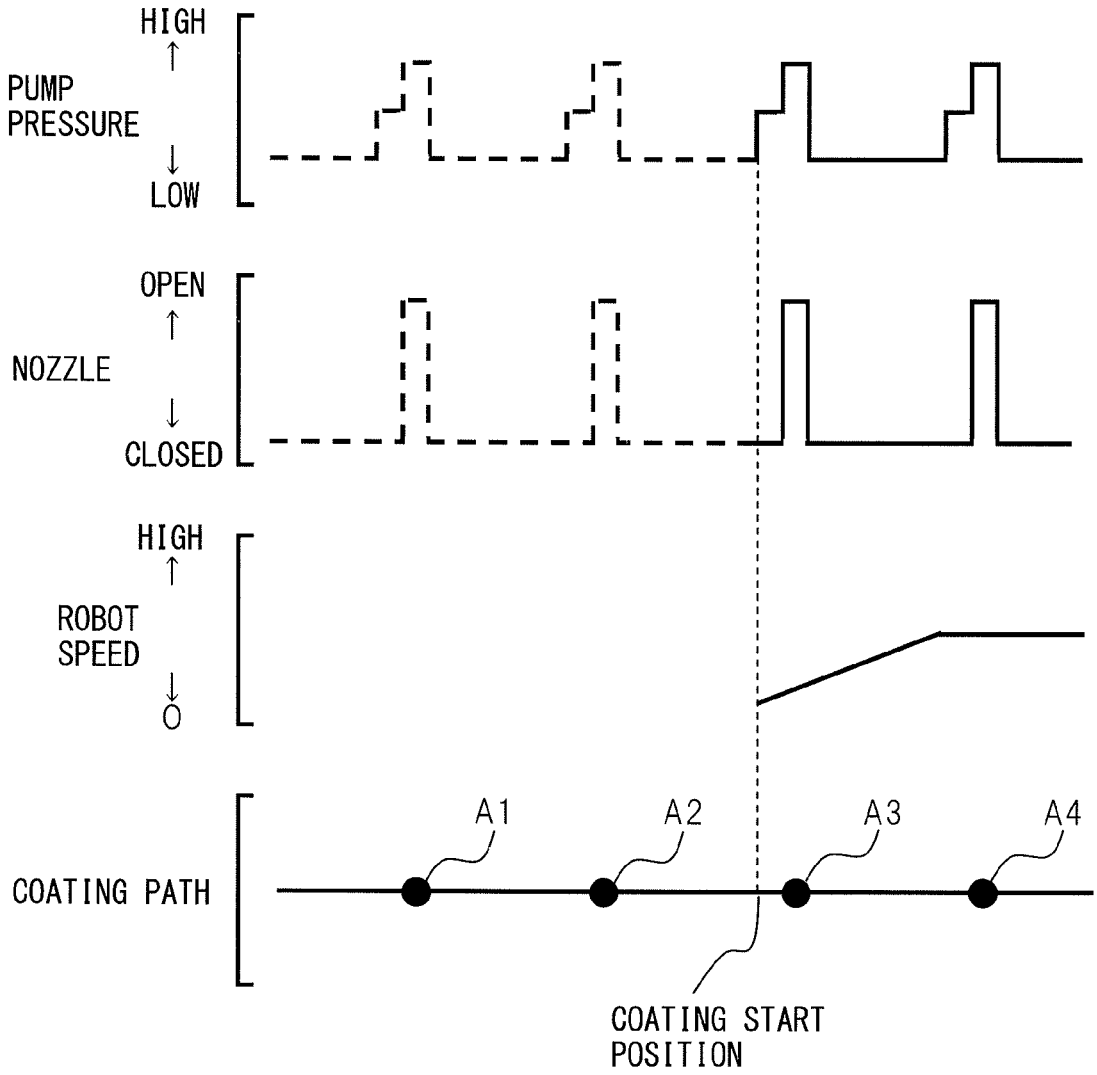
FIG. 6 is a view which shows a time chart of a pump pressure, nozzle, robot speed, and coating path when restarting coating work.

In this regard, FIG. 6 is a view which shows a time chart of the pump pressure, nozzle, robot speed, and coating path at the time of resuming coating work. As explained referring to FIG. 5, after the robot 11 is made to move to the coating start position of the planned coating position A3, the speed of the robot is raised from zero and, as shown in FIG. 6, the pump 13 and nozzle 14 are driven. Due to this, the planned coating positions A3, A4 can also be coated with the viscous material by a coating amount similar to the planned coating positions A1, A2.

Figure 7:
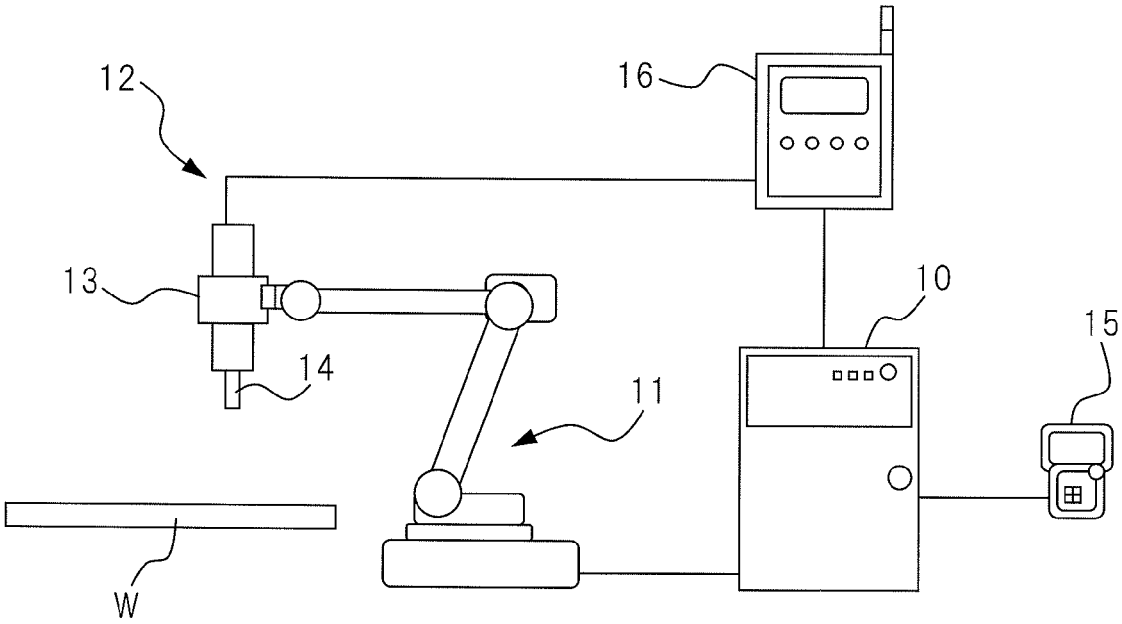
FIG. 7 is a schematic side view of a robot coating system according to a second embodiment of the present invention.

FIG. 7 is a schematic side view of a robot coating system according to a second embodiment of the present invention. As can be seen from FIG. 7, in the second embodiment, a coating work controller 16 is arranged between the robot controller 10 and the coating gun 12. The coating work control device 16 controls the coating gun 12, so the additional robot shaft 17 is eliminated in the second embodiment.

Figure 8:
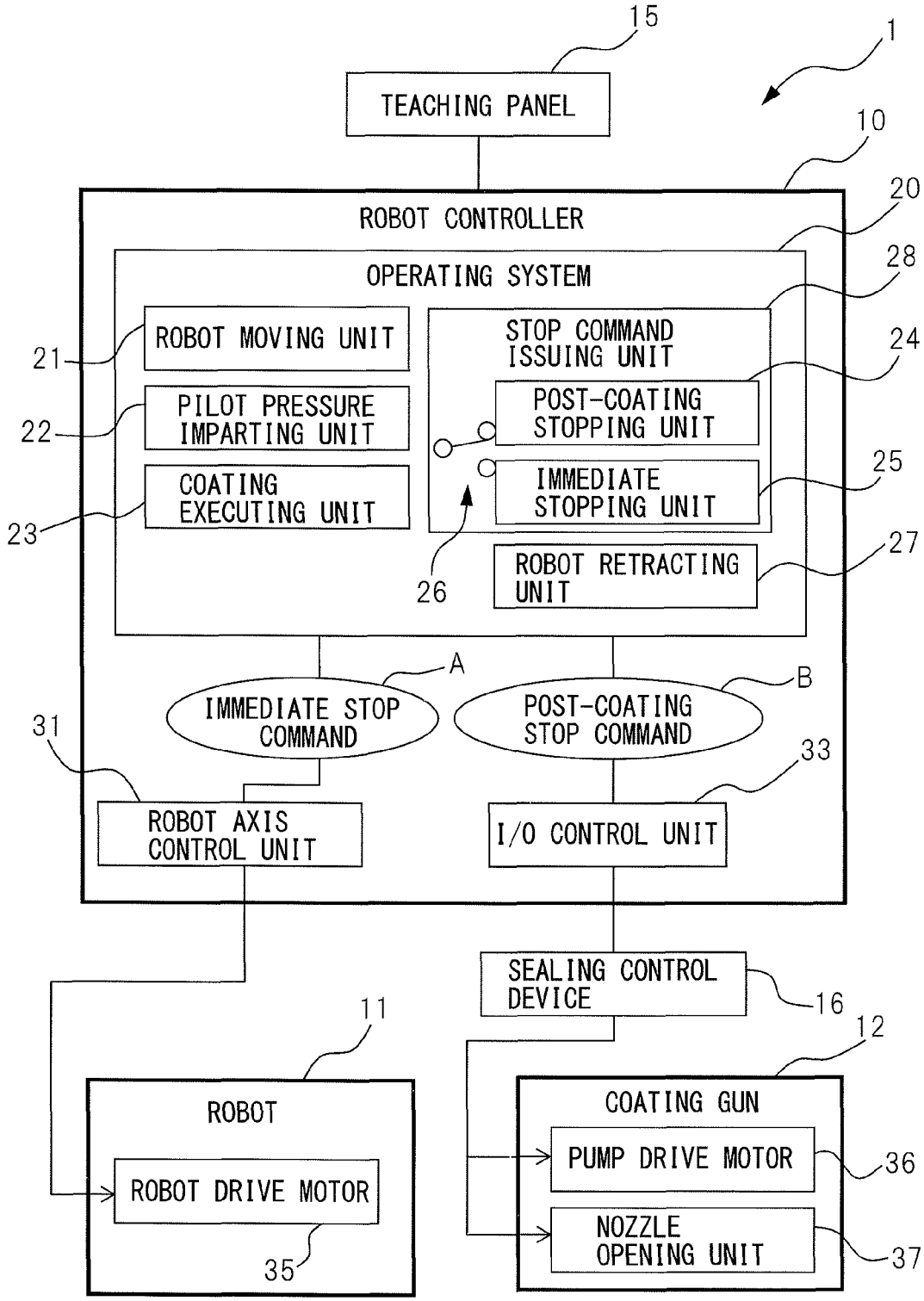
FIG. 8 is a functional block diagram of a robot coating system which is shown in FIG. 7.

Furthermore, FIG. 8 is a functional block diagram of the robot coating system which is shown in FIG. 7. As can be seen from FIG. 8, the robot controller 10 is not provided with a pump control unit 32. Therefore, if a post-coating stop command B is issued to the pump 13, the command is supplied to the coating work control device 16 through the I/O control unit 33. Further, the coating work control device 16 supplies a post-coating stop command B to the pump drive motor 36 and nozzle opening unit 37. Therefore, in the second embodiment as well, even if a stop command is issued in the middle of the coating work, the coating work is continued until the coating work at the corresponding planned coating position A ends. For this reason, it will be understood that similar effects are obtained as explained above.

Figure 9:
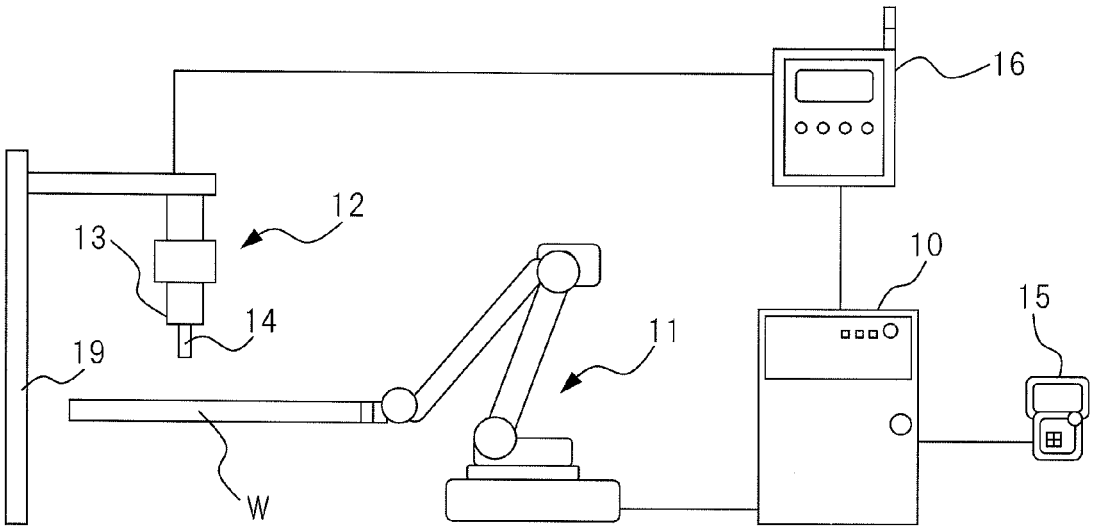
FIG. 9 is a schematic side view of a robot coating system according to a third embodiment of the present invention.

Further, FIG. 9 is a schematic side view of a robot coating system according to a third embodiment of the present invention. The functional block diagram of the robot coating system in the third embodiment is generally similar to those which is shown in FIG. 8. In the third embodiment, the workpiece W is attached to the front end of the robot 11 or is held by the hand of the robot 11. Further, the coating gun 12 is supported by the coating gun support 19.

In the third embodiment, the robot moving unit 21 makes the robot 11 which holds the workpiece W move so that the front end of the nozzle 14 is successively positioned at a plurality of planned coating positions on the workpiece W. In this way, even if the coating gun 12 is supported by the coating gun support 19 and the robot 11 makes the workpiece W move, it is clear to a person skilled in the art that effects similar to the above are obtained.

In this regard, FIG. 10 is a view which shows the coating conditions which are displayed on the teaching panel 15. FIG. 10 shows a first coating condition. At the coating conditions #1, the flow rate of the viscous material at the time of coating is set to 1 cc/sec, the coating time corresponding to the opening time of the nozzle 14 is set to 50 msec, the ratio of the pilot pressure Pr with respect to the discharge pressure Pd, that is, the pilot pressure rate, is set to 50%, and the pilot pressure time during which the pilot pressure Pr is maintained set to 50 msec.

Further, FIG. 11 is a view which shows part of a coating program which is displayed on a teaching panel. The "position" which is shown in FIG. 11 shows one planned coating position. Further, the "SS" of FIG. 11 is an abbreviation for "Sealing Start", while "SS[1]" means the start of coating of the sealing material as a viscous material. Furthermore, the "smooth" of FIG. 11 means the robot 11 is made to operate smoothly.

Part of the coating conditions and coating program is displayed on the teaching panel 15. Further, the operator refers to the display content while using the teaching panel 15 to teach the robot coating system 1. The teaching panel 15 displays the coating time of the viscous material (nozzle opening time) (FIG. 10) and the planned coating position (FIG. 11). Therefore, it will be understood that the operator can refer to the teaching panel 15 to easily and simply perform the teaching work for scatter coating.

ADVANTAGEOUS EFFECTS OF INVENTION

In the first aspect, even if a stop command of the robot is issued, the pump is made to stop after the coating work at the corresponding planned coating position ends. Therefore, even if the coating work of scatter coating is interrupted and then the coating work is resumed, the amount of coating of the viscous material will not change from the intended coating amount. Therefore, it is possible to coat a coating amount similar to the coating amount at another planned coating position.

In the second aspect, either the post-coating stopping unit and the immediate stopping unit can be selected. Therefore, when scatter coating the viscous material, the post-coating stopping unit is selected, while when coating the viscous material by a straight continuous path, the immediate stopping unit is selected. That is, selection in accordance with the content of the coating work becomes possible.

In the third aspect, even if the robot passes the coating start position before the robot completely stops after a robot stop command is issued, the robot can be returned to the coating start position. For this reason, at the time of scatter coating, it is possible to prevent coating work at part of the planned coating positions from being skipped.

In the fourth aspect, at least the planned coating position and coating time is displayed. Therefore, it is possible for an operator to easily and simply perform teaching work for scatter coating.

Typical embodiments were used to explain the present invention, but it will be understood that a person skilled in the art could make the above-mentioned changes and various other changes, deletions, and additions without departing from the scope of the present invention.

The invention claimed is:

1. A robot coating system which includes a robot which is provided with a coating gun which uses a pump to coat a viscous material and in which said coating gun coats a plurality of planned coating positions of a workpiece with said viscous material in exactly predetermined amounts to thereby scatter coat the viscous material, the robot coating system comprising:

a robot moving unit configured to make said robot which is provided with said coating gun successively move to said plurality of planned coating positions at the time of operation of said robot coating system, a pilot pressure imparting unit configured to make said pump of the coating gun before reaching said planned coating positions and imparts to said viscous material a predetermined pilot pressure without coating said viscous material, a coating executing unit configured to execute coating work of said viscous material by a predetermined flow rate over a predetermined coating time when said coating gun has reached a planned coating position or immediately before that, a post-coating stopping unit configured to continue said coating work by said coating executing unit and make said pump stop after the end of said coating work when said coating executing unit is executing said coating work and a first command is issued to stop said robot, an immediate stopping unit configured to make said pump stop without continuing said coating work by said coating executing unit when said coating executing unit is executing said coating work and a second command is issued to stop said robot, and a selection unit configured to execute one of said post-coating stopping unit and said immediate stopping unit for functioning.

2. The robot coating system as set forth in claim 1, further comprising a robot retracting unit configured to make said robot retract to at least said coating start position when a stop command of said robot is issued and said robot stops over the coating start position of said planned coating position before coating said viscous material at one planned coating position among said plurality of planned coating positions.

3. The robot coating system as set forth in claim 1, further comprising an input unit which teaches coating conditions of said coating work and a display unit which displays at least one coating condition which is taught from said input unit including a coating time and flowrate of said viscous material and at least one planned coating position.

4. The robot coating system as set forth in claim 2, further comprising an input unit which teaches coating conditions of said coating work and a display unit which displays at least one coating condition which is taught from said input unit including a coating time and flow rate of said viscous material and at least one planned coating position.

* * * * *